US005674826A

United States Patent [19]

McMullen

[11] Patent Number: 5,674,826

[45] Date of Patent: Oct. 7, 1997

[54] CLEANING COMPOSITION

[76] Inventor: Robert W. McMullen, 6246 Quarterhorse Trail, Tallahassee, Fla. 32312

[21] Appl. No.: 582,175

[22] Filed: Jan. 2, 1996

[51] Int. Cl.[6] ..... C11D 7/54; C11D 9/00

[52] U.S. Cl. ..... 510/181; 510/180; 510/182

[58] Field of Search ..... 510/180, 181, 510/182

[56] References Cited

U.S. PATENT DOCUMENTS 3,915,880 10/1975 Sepulveda ..... 252/99

4,287,080 9/1981 Siklosi ..... 252/104

4,786,432 11/1988 Kanfer et al. ..... 252/120

4,952,248 8/1990 Aberg ..... 134/40

5,302,311 4/1994 Sugihara et al. ..... 252/102

*Primary Examiner*—Paul Lieberman

*Assistant Examiner*—Necholus Ogden

*Attorney, Agent, or Firm*—Peter Loffler

[57] ABSTRACT

A cleaning composition comprises water, liquid soap, a polishing agent such as Rottenstone, and alcohol. The cleaning composition is effective for removal of dirt and grime from glass, plastic, floors and other similar surfaces. The cleaning composition disinfects and leaves a shiny surface. The cleaning composition is relatively environmentally friendly.

6 Claims, No Drawings

CLEANING COMPOSITION

BACKGROUND OF THE INVENTION

1. Field of the Invention

The present invention relates to a cleaning composition and more specifically to a cleaning composition that cleans glass, plastic, and other similar surfaces.

2. Background of the Prior Art

There is always a need for cleaning compositions to clean glass surfaces such as windows, table tops, eye glasses and the like. Many products such as Windex and the like are commercially available. Many of the products tend to perform satisfactorily. However, most have compositions that are rich in chemistry. As a result, these products have an adverse effect on the environment, both real and perceived. With the environmental consciousness of the world, this effect is a drawback to such products.

Therefore, there is a need in the art for a surface cleaning product that lacks the deleterious effect on the environment. Such a product must be effective in accomplishing the cleaning task and should be simple to compose.

SUMMARY OF THE INVENTION

The cleaning composition of the present invention addresses the aforementioned needs in the art. The cleaning composition is a relatively simple composition that cleans many surfaces including glass, plastic, counters and others. The cleaning composition disinfects the cleaned surface and leaves the surface with a shine. The composition of the cleaning composition does not have a heavy impact on the environment.

The cleaning composition comprises water, alcohol, soap, and a polishing agent such as Rottenstone. The Rottenstone may be emulsified or otherwise homogenized into the solution. Color or tint may be added for enhanced consumer appeal.

DETAILED DESCRIPTION OF THE PREFERRED EMBODIMENT

The cleaning composition of the present invention comprises, by volume, from about 1 to about 2 pints of isopropyl alcohol, from about ⅛ to about 2 teaspoon of ordinary liquid soap, from about 1/16 to about 2 teaspoons of polishing agent such as, but not limited to, Rottenstone with the balance being water in order to produce 1 gallon of cleaning composition.

A preferred composition of the cleaning composition comprises, by volume about 1.5 pints of isopropyl alcohol, about ½ teaspoon of ordinary liquid soap, about ¼ teaspoon of polishing agent such as, but not limited to, Rottenstone with the balance being water in order to produce 1 gallon of cleaning composition.

The use of isopropyl alcohol disinfects the surface that is cleaned. Its relative amount within the composition may be varied in order to achieve a desired level of disinfection. The liquid soap may be of any commercially available type such as Ivory liquid soap, Dawn liquid soap, and the like. The liquid soap performs the actual cleaning and its relative amount within the composition may be varied. The polishing agent gives the cleaned surface a glossy shine. Its relative amount within the composition may be varied in order to achieve a desired level of shine.

The Rottenstone may be emulsified or otherwise homogenized into the overall composition. This homogenization may be achieved by any appropriate means.

If desired, color or tint may be added to the solution in order to increase consumer appeal. Any appropriate coloring or tinting composition may be utilized including food color.

While the invention has been particularly shown and described with reference to an embodiment thereof, it will be understood by those skilled in the art that various changes in form and detail may be made without departing from the spirit and scope of the invention.

I claim:

1. A cleaning composition consisting:

by volume, from about 1 to about 2 pints of isopropyl alcohol;

from about ⅛ to about 2 teaspoons of liquid soap;

from about 1/16 to about 2 teaspoons of Rottenstone; and the balance being water in order to produce 1 gallon of the cleaning composition.

2. The composition as in claim 1 wherein the Rottenstone is homogenized into the cleaning composition.

3. The composition as in claim 1 further including a coloring agent in order to vary the color of the cleaning composition.

4. A cleaning composition consisting of:

by volume, about 1.5 pints of isopropyl alcohol;

about ½ teaspoon of liquid soap;

about ¼ teaspoon of Rottenstone; and the balance being water in order to produce 1 gallon of the cleaning composition.

5. The composition as in claim 4 wherein the Rottenstone is homogenized into the cleaning composition.

6. The composition as in claim 1 further including a coloring agent in order to vary the color of the cleaning composition.

* * * * *